United States Patent [19]

Hodgson

[11] 4,066,889

[45] Jan. 3, 1978

[54] ILLUMINATED SKI POLE

[75] Inventor: David A. Hodgson, Hamburg, N.Y.

[73] Assignee: International Power Pole, Ltd., Hamburg, N.Y.

[21] Appl. No.: 744,283

[22] Filed: Nov. 22, 1976

[51] Int. Cl.[2] ..... F21V 33/00

[52] U.S. Cl. ..... 362/102; 280/11.37 B; 280/11.37 H; 280/11.37 D; 280/11.37 L; 280/11.37 E; 280/11.37 J; 362/205

[58] Field of Search ..... 240/6.42, 2 R, 6.4 R; 280/11.37 B, 11.37 D, 11.37 H, 11.37 L, 11.37 E, 11.37 J

[56] References Cited

FOREIGN PATENT DOCUMENTS 926,485 4/1947 France.

536,423 5/1941 United Kingdom.

*Primary Examiner*—Brooks H. Hunt

*Attorney, Agent, or Firm*—Christel & Bean

[57] ABSTRACT

A ski pole has a tubular body member with an arcuate or circular transparent or translucent insert in the wall thereof comprising a window element and a light source within the body member illuminates this window member and also projects light along the interior of the body member to an inclined mirror element at a lower portion of the ski pole. The light impinging on this mirror element is directed radially outwardly through a lens member fitted into the wall of the ski pole so that reflected light from the mirror is projected outwardly to illuminate the surrounding terrain.

5 Claims, 5 Drawing Figures

2
35
36
30
31
20
34
10
33
3
41
11
28
32
22
27
37
4
14
23
15
5
40

ILLUMINATED SKI POLE

BACKGROUND OF THE INVENTION

This invention relates to ski poles and more particularly to illuminating means associated with ski poles for the dual purpose of illuminating the ski pole itself and for emitting light therefrom to illuminate the surrounding terrain.

Night skiing is widely practiced but the illumination provided for this purpose is often inadequate and usually does not extend beyond the normal ski run. Skiers who deviate from the normal ski run are often the ones most in need of illumination both as signal to others and for illumination of the immediately surrounding terrain. Also, the illumination normally provided by the ski run operator is subject to power failures of one kind or another.

SUMMARY OF THE INVENTION

The present invention provides means for illuminating a portion of the length of a ski pole to render the ski pole visible to persons at a considerable distance from the skier. The same source of illumination is employed for emitting a diverging light from a lens located at a lower portion of the ski pole to illuminate the immediately surrounding terrain and in fact the skier may use this latter means in the manner of a flash light for lighting his way in darkness by directing the light from the lens member in various directions.

DESCRIPTION OF THE ILLUSTRATED EMBODIMENT

Figures 1, 2, 3, 4, 5:
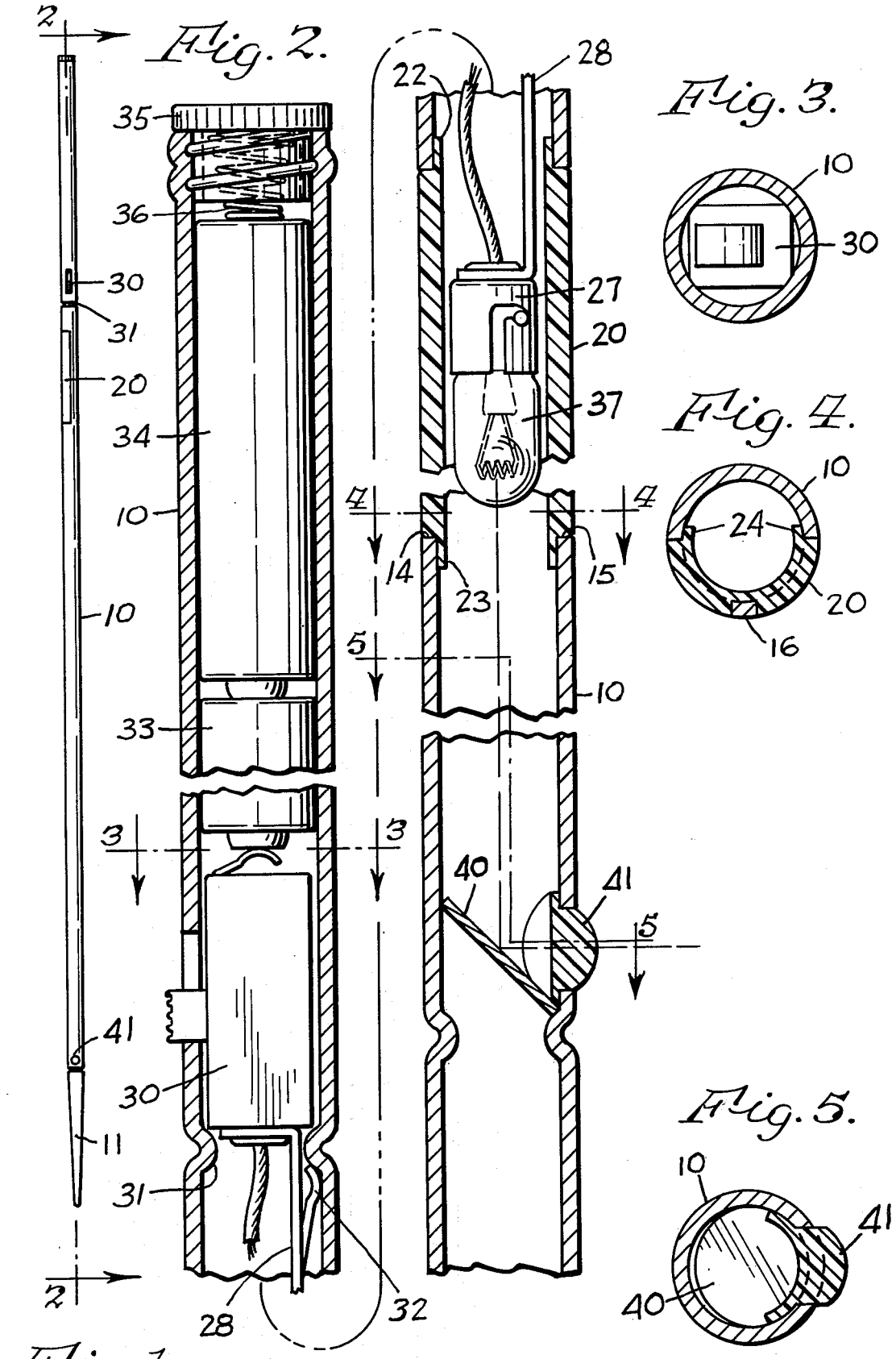
FIG. 1 is a general elevational view of a ski pole constructed in accordance with one form of the present invention.
FIG. 2 is a composite view showing, in longitudinal cross section, the upper and lower portions of the ski pole of FIG. 1.
FIG. 3 is a cross sectional view on the line 3—3 of FIG. 2.
FIG. 4 is a cross sectional view on the line 4—4 of FIG. 2.
FIG. 5 is a cross sectional view on the line 5—5 of FIG. 2.

In FIG. 1 the numeral 10 designates a tubular ski-pole having a somewhat pointed formation 11 at its lower end. The tubular body of the ski pole 10 is slotted at a point on the upper portion thereof to receive a transparent or translucent lens member which is illuminated by a light source within the ski pole as will presently appear. In the illustrative instance the ski pole has a pair of vertically extending slots 14 and 15 divided by a vertical strip 16 which is integral with the tubular body of the ski pole and reinforces the same in the vicinity of the slots 14 and 15.

A semi-circular shell 20 of transparent or translucent material is fitted within the body of ski pole 10 to cover the slots 14 and 15 to serve as a window in the wall of the ski pole. Shell 20 may be assembled in a transversely curled condition and then expanded into the configuration illustrated in FIGS. 2 and 4 or any other means for fitting a transparent or translucent closure into the wall of ski pole 10 may be employed. In the illustrated instance the shell member 20 has internal flanges 22, 23 and 24 extending about its margin and fitting within the tubular body of ski pole 10 as shown in FIGS. 2 and 4 and is grooved vertically to receive strap 16 as shown in FIG. 4.

The illuminating means of the embodiment shown herein by way of example will now be described. A lamp socket 27 is supported by a bar 28 which connects with the lower end of an on-off switch 30. Switch 30 seats downwardly against an internal bead 31 formed in ski pole 10 and bar 28 has an ear 32 struck therefrom which engages beneath bead 31 to retain switch 30 releasably in the position illustrated in FIG. 2.

A pair of dry cells 33 and 34 are disposed in end to end relation above switch 30 and in electrical contact therewith and a compression coil spring 35 retained by a screw threaded cap or plug 36 at the upper end of the ski pole resiliently urges the dry cells in contact with each other and with switch 30 and serves as a ground connection for the dry cells. The operating button of switch 30 may be held depressed in inserting the switch in the upper end of the ski pole and will thus remain depressed until it reaches the opening in the wall of the ski pole as shown in FIG. 2.

A lamp 37 in socket 27 illuminates the transparent or translucent shell 20 to cause the same to be visible to others at substantial distances from the skier. In addition, and just as importantly, lamp 37 projects light downwardly to a mirror or reflector 40 which directs this projected light through a diverging lens 41 of glass or transparent plastic material which is fitted in the wall of ski pole 10 adjacent to the lower end thereof.

Thus the light emitted from lens 41 may be pointed in various directions by the user to illuminate the surrounding terrain or may be pointed in other directions as needed by the user to serve the purpose of a flashlight.

A preferred embodiment of this invention having been hereinabove described and illustrated in the drawings, it is to be understood that numerous modifications thereof can be made without departing from the spirit and scope of this invention as defined in the appended claims.

I claim:

1. In a ski pole, a tubular body member, an arcuate window element of transparent or translucent material set into the wall of said tubular body member to form a smooth continuation of the outer wall thereof, a light source within said tubular body member to illuminate said window element and project light lengthwise in the interior of said body member, a lens in the wall of said body member relatively remote from said window element in an axial direction and a mirror element adjacent to said lens for reflecting said projected light through said lens member to be emitted laterally of said ski pole.

2. A ski pole according to claim 1 wherein said window element is disposed in an upper portion of said tubular body member and said mirror element and said lens member are disposed adjacent to the lower end of said tubular body member.

3. A ski pole according to claim 1 wherein said lens diverges light passing therethrough from said mirror element.

4. A ski pole according to claim 1 wherein said tubular body member contains a dry cell means for energizing said light source and wherein a switch is interposed between the dry cell means and the light source with a switch operating member projecting outwardly through the wall of said tubular body member.

5. A ski pole according to claim 4 wherein the upper end of said tubular body member is threaded to engage a threaded cap member with spring means acting between said cap and said dry cell means for maintaining the dry cell means and said switch in electrical contact.

* * * * *